US006241551B1

(12) United States Patent
Watanabe

(10) Patent No.: US 6,241,551 B1
(45) Date of Patent: Jun. 5, 2001

(54) DIVIDED-TYPE CONNECTOR

(75) Inventor: Hiroshi Watanabe, Shizouka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/457,344

(22) Filed: Dec. 8, 1999

(30) Foreign Application Priority Data

Dec. 21, 1998 (JP) ..... 10-362948

(51) Int. Cl.[7] ..... H01R 13/73
(52) U.S. Cl. ..... 439/557; 439/350
(58) Field of Search ..... 439/557, 553, 439/552, 554, 34, 157, 350, 357, 358, 352, 353

(56) References Cited

U.S. PATENT DOCUMENTS 6,033,241 * 3/2000 Iwata et al. ..... 439/557

FOREIGN PATENT DOCUMENTS 5-234634 9/1993 (JP) .
9-293567 11/1997 (JP) .
9-306582 11/1997 (JP) .

* cited by examiner

*Primary Examiner*—Paula Bradley
*Assistant Examiner*—Tho D. Ta
(74) *Attorney, Agent, or Firm*—Morgan, Lewis & Bockius LLP

(57) ABSTRACT

There is provided a divided-type connector comprising a male connector 20 and a female connector 40, one of the connectors being divided-type into a plurality of connector units, so that each of the connector units so divided-type is coupled to the other connector, wherein the one of the connectors comprises a fixing part 23 having an opening hole 24 formed in a coupling face thereof and a moving part 22 adapted to be received in the opening hole 24 for locking therein with a part thereof being left projecting from the coupling face in a coupling direction, and wherein after the moving part 22 is coupled to the other connector, the fixing part 23 is coupled to the other connector while the moving part 22 is being moved in a direction opposite to the coupling direction into the fixing part.

4 Claims, 9 Drawing Sheets

DIVIDED-TYPE CONNECTOR

BACKGROUND OF INVENTION

1. Field of the Invention

The present invention relates to a divided-type connector and more particularly to a construction for a divided-type connector that can reduce a coupling force required for coupling between a male connector and a female connector so as to obtain good coupling operability.

2. Related art

As a conventional divided-type connector 80, for instance, Japanese Unexamined Patent Publication HEI. 5-234634 discloses a divided-type connector. As is shown in FIG. 9, this divided-type connector comprises a male connector 81 and a female connector 82 that can be fitted on the male connector 81.

The male connector 81 is divided-type into two connector units 83, 84, which are incorporated into a common connector frame 85. The respective connector units 83, 84 of the male connector 81 are individually operated for coupling (or fitting in). In other words, a coupling between the male connector 81 and the female connector 82 is performed in two stages for the respective connector units 83, 84, whereby a fitting force is reduced that is required for the male connector 81 to be fitted in the female connector.

In the conventional divided-type connector 80 described above, although the fitting force needed when the male connector 81 is fitted in the female connector 82 can be reduced, since the respective connector units 83, 84 of the male connector 81 are independently fitted in the female connector 82, there still remains a problem that good coupling operability cannot be obtained.

SUMMARY OF INVENTION

The present invention has been made in view of the above problem, and an object thereof is to provide a divided-type connector that can provide good coupling operability while reducing a fitting force needed when the male connector is coupled to the female connector.

With a view to attaining the aforesaid object, according to the present invention, there is provided a divided-type connector comprising a male connector and a female connector, one of the connectors being divided-type into a plurality of connector units, so that each of the connector units so divided-type is coupled to the other connector, wherein the one of the connectors comprises a fixing part having an opening hole formed in a coupling face thereof and a moving part adapted to be received in the opening hole for locking therein with a part thereof being left projecting from the coupling face in a coupling direction, and wherein after the moving part is coupled to the other connector, the fixing part is coupled to the other connector while the moving part is being moved in the fixing part.

In this divided-type connector, either of the male and female connectors comprises the fixing part having the opening hole and the moving part adapted to be locked on the fixing part with a part thereof being left projecting. In this construction, the projecting moving part is first coupled to the other connector, and thereafter the fixing part is coupled to the other connector with the moving part being moved in a direction opposite to a coupling direction. Therefore, since a fitting force required when the male and female connectors are coupled to each other is divided, this serves to reduce the needed fitting force, and since the moving part and the fixing part can be coupled to each other in a single inserting operation, a good coupling operability can be obtained.

An invention according to the present invention, there is provided a divided-type connector, wherein the moving part is locked on the fixing part by means of locking means disposed on sides of the moving part, and wherein the locking of the locking means with the fixing part is released when the moving part is fitted in the other connector, so that the locking means are then fixed to the other connector.

In this divided-type connector, the moving part is first locked on the fixing part with the locking means, and the locking of the moving part with the fixing part is released when the moving part is coupled to the other connector for fixation to the other connector. Thus, the locking means are used not only for locking with the fixing part but also for fixing to the other connector, thereby making it simplify the construction of the connector.

According to the present invention, there is provided a divided-type connector, wherein said one of the connectors comprises first fixing means disposed on external sides thereof for securing a coupled state with the other connector, and wherein the first fixing means can come to be fixed for the first time when not only the moving part but also the fixing part is coupled to the other connector.

In this divided-type connector, the first connector means can come to be fixed for the first time in a state in which the one of the connectors is coupled to the other connector when not only the moving part but also the fixing part is coupled to the other connector, whereby a half-coupled state of the moving part and the fixing part can easily be detected, thereby making it possible to prevent a failure in electric connection between the connectors.

According to the present invention, there is provided a divided-type connector, wherein the one of said connectors and the other connector are adapted to be coupled together at a wall face via a connector mounting hole, the other connector having second fixing means adapted to be fixed at the wall face, wherein the one of the connectors is fixed at the wall face by means of the first fixing means until it is coupled to the other connector, and wherein the fixation effected by the first locking means is released as a coupling operation between the one of the connectors and the other connector proceeds, the other connector being fixed to the wall face by means of the second fixing means when the coupling of the other connector with the one of the connectors is completed.

In this divided-type connector, the one of the connectors is fixed in the connector mounting hole by means of the first fixing means before the respective connectors are coupled to each other. In this state, the fixation by means of the first fixing means is released when the one of the connectors and the other connector are operated to be coupled to each other, and the other connector, which has completed the coupling with the one of the connectors, is fixed to the wall face by means of the second fixing means. Thus, one of the connectors and the other connector are fixed at the wall face by means of the second fixing means via the connector mounting hole. For instance, therefore, when the connector is mounted on the vehicle body, a mounting operation of the connector to the vehicle body can be simplified to a large extent, and moreover the respective connectors can be coupled to each other in a more secured fashion.

DETAILED DESCRIPTION OF PREFERRED EMBODIMENTS

Referring to the accompanying drawings, a preferred mode of a connector construction according to the present invention will be described in detail below.

Figure 1:
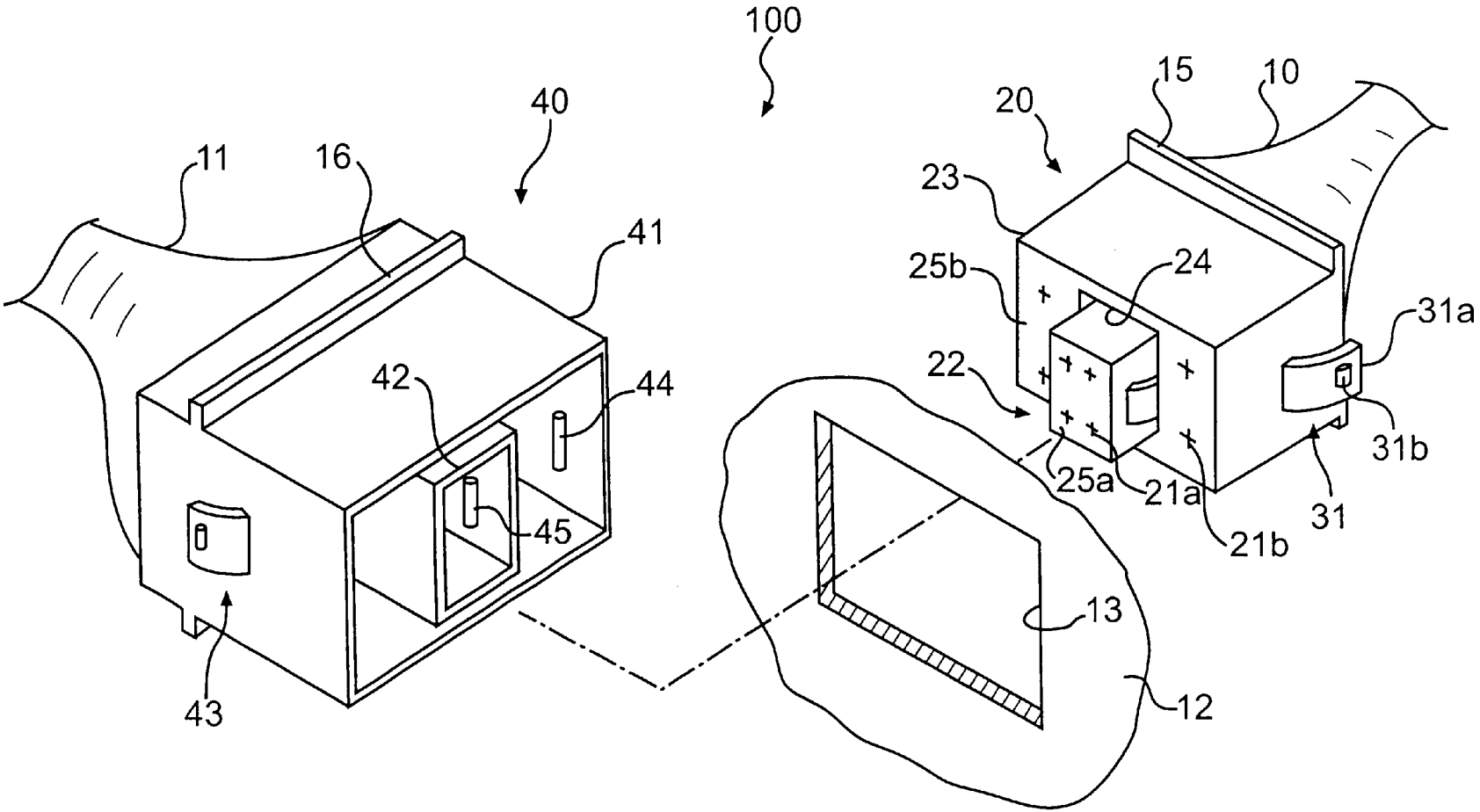
FIG. 1 is a perspective view showing a state in which a divided-type connector according to the present invention is fitted together.

FIG. 1 is a perspective view showing a divided-type connector according to the present invention which is in a pre-coupled state. Referring to FIG. 1, a connector 100, which is interposed between a wiring harness side and an accessories side when mounted on the vehicle body (not shown), comprises a male connector 20 coupled to the wiring harness 10 side and a female connector 40 coupled to a wiring 11 on the accessories side, and the male connector 20 is fitted in the female connector 40 via a mounting hole 13 formed in the vehicle body 12 of a vehicle when the connector 100 is mounted on the vehicle. Thus, the male connector 20 allows electrical connection terminals (not shown) of the female connector 40 to be fittingly inserted into terminal receiving portions 21*a*, 21*b* of the male connector 20, whereby the wiring harness side and the accessories side are electrically connected to each other.

The male connector 20 comprises a moving part 22 having a divided part of the whole coupling terminals of the connector 100 and a fixing part 23 having a moving part receiving portion (an opening hole) formed in a central portion thereof for insertion of the moving part 22, and the moving part 22 is held in such a state that the moving part 22 projects forwardly a predetermined distance from a terminal face (a coupling face) of the fixing part 23.

Figure 2:
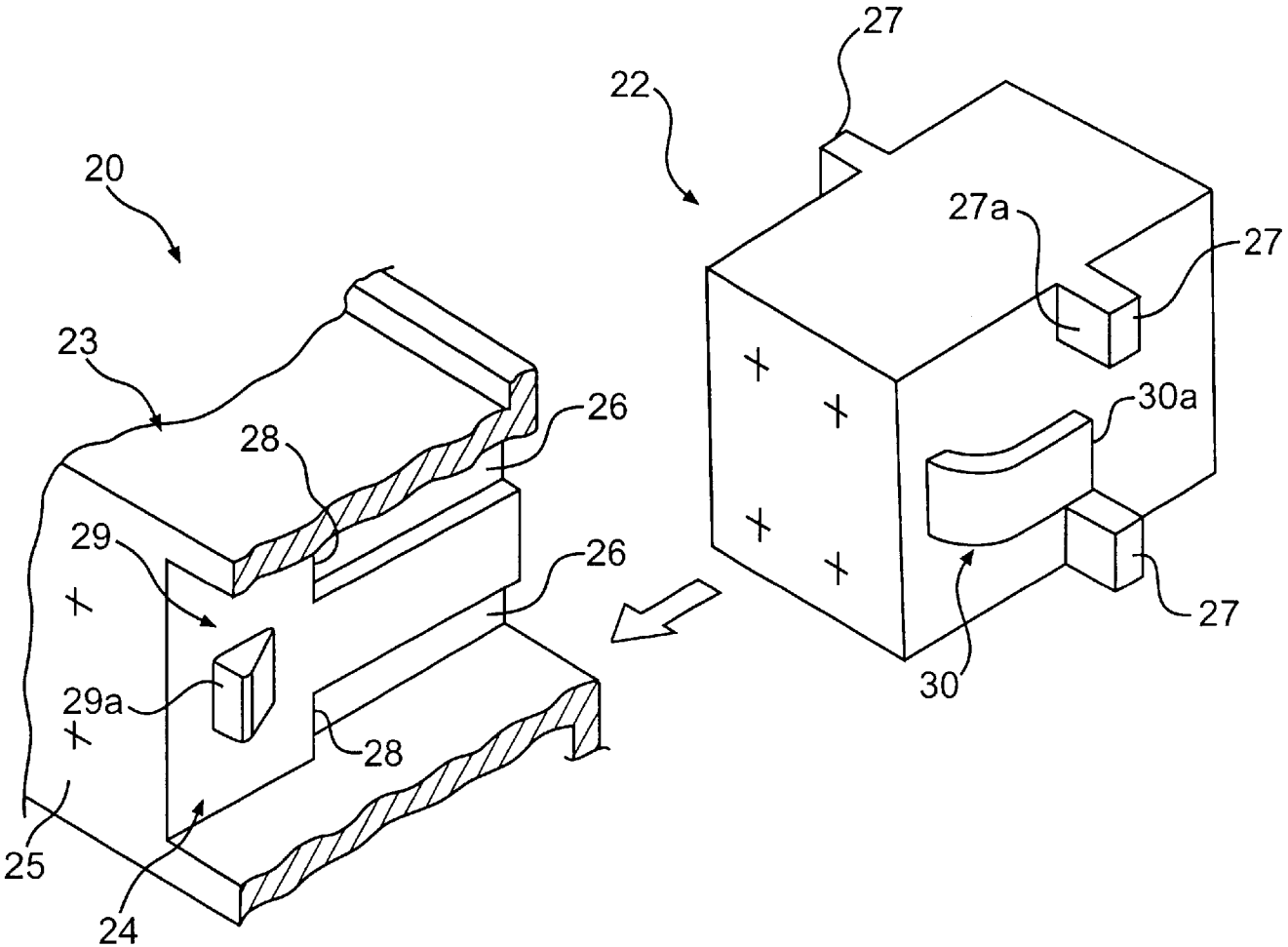
FIG. 2 is a view showing a combination of a fixing part and a moving part of the divided-type connector shown in FIG. 1.

In other words, as shown in FIG. 2, two upper and lower pairs of, i.e., four in total, moving part guiding grooves 26 are formed in internal sides of the moving part-receiving portion 24 of the fixing part 23.

The respective moving part guiding grooves 26 are formed in such a manner as to allow guides 27 formed on external sides of the moving part 22 in such a manner as to project therefrom to sliding therealong in a direction in which the moving part 22 is fitted in, whereby the guide grooves 26 guide the moving part 22 in the fitting-in direction within the fixing part 23.

In addition, the guides 27 are adapted to abut against terminating faces 28 of the moving part guide grooves at front faces 27*a* thereof and thus function as a stopper for preventing the moving part 22 from passing through the moving part receiving portion 24 of the fixing part 23 to fall thereout in the fitting-in direction.

Moving part holding projections 29 are provided on inner wall faces of the moving part receiving portion 24 in such a manner as to project therefrom, and formed each on the moving part holding projections 29 is an engagement face 29*a* with which an end face 30*a* of a locking arm (locking means) 30 is brought into abutment which is formed on a side of the moving part 22.

On the other hand, the female connector 40 is constructed so as to be fitted on the moving part 22 and the fixing part 23 of the male connector 20, and a connector main body 41 of the female connector 40 has electrical coupling terminals (not shown) provided on a face thereof confronting the male connector 20 in such a manner as to confront in turn the terminal receiving portions 21*a*, 21*b* of the male connector 20.

To be specific, a moving part fitting-in frame 42 is formed inside the connector main body 41 for fitting insertion between the male connector 20 and the moving part 22, although not shown, male terminals are arranged in the moving part fitting-in frame 42 for insertion into the terminal receiving portion 21*a* of the moving part 22. In addition, terminals are arranged in a similar fashion outside the moving part fitting-in frame 42 inside the connector main body 41 for insertion into the terminal receiving portion 21*b* of the male connector 20.

Vehicle body supporting arms (second fixing means) 43 are provided on external sides of the connector main body 41 of the female connector 40 for support of the female connector 40 on the vehicle body 12 after the connectors are fitted in each other.

Furthermore, male connector holding projections 44 for holding the male connector 20 are formed on internal wall faces of the connector main body 41 in such a manner as to engage the end face 31*a* of the connector fixing arms (the first fixing means) 31 formed on the external sides of the fixing part 23 of the male connector 20.

Then, moving part fitting projections 45 are formed on internal wall faces of the moving part fitting-in frame 42 for securing the fitting of the moving part 22 in the moving part fitting-in frame 42, whereby the fitted-in state of the moving part 22 after it has been inserted in the frame can be held.

In addition, stoppers are formed on upper and lower faces of the connector main body 41 in such a manner as to abut against upper and lower portions of the mounting hole 13 of the vehicle body 12 with a view to preventing the female connector 40 passing through the mounting hole 13 to fall thereout in the insertion or forward direction.

Described next will be a procedure of fitting the female connector 40 on the male connector 20 having the moving part 22 constructed as described above via the vehicle body 12.

Figure 3:
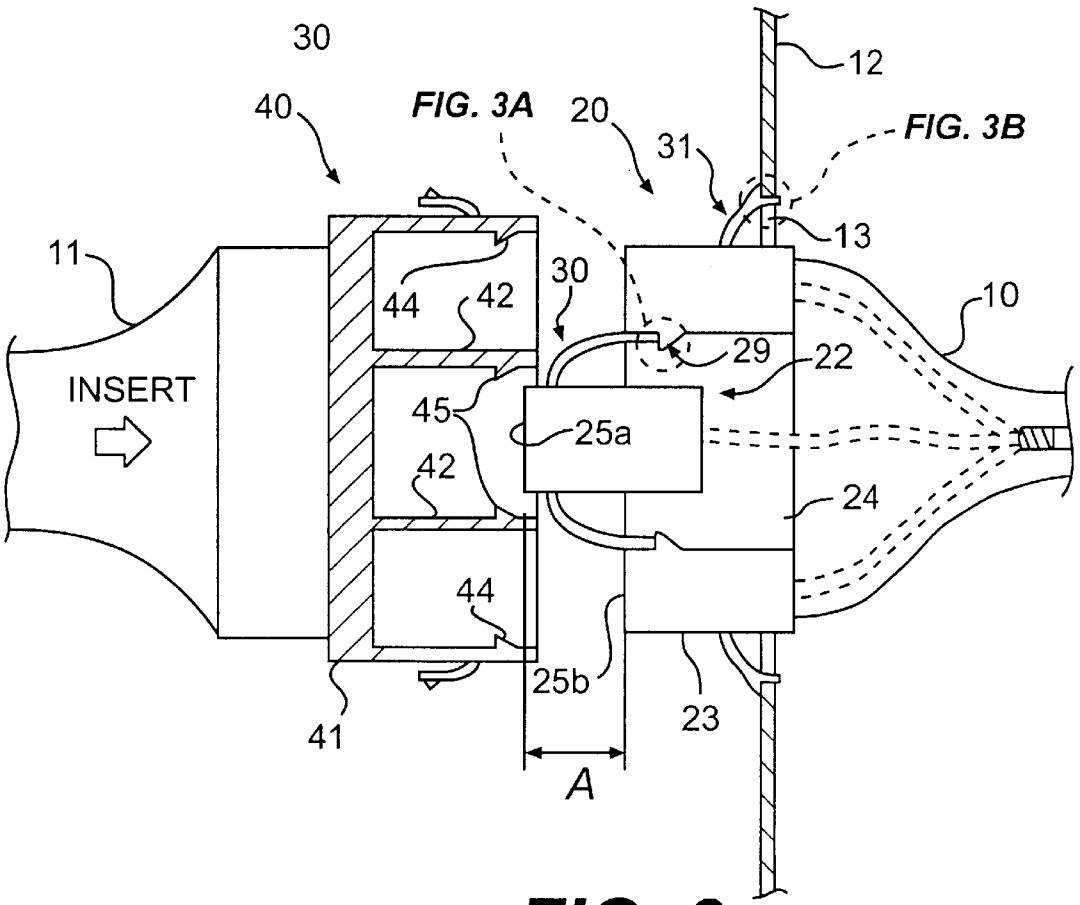
FIG. 3 is a view showing a state in which a male connector is fixed to a vehicle side with the moving part being locked thereon in such a manner as to project from the male connector.
Figure 3A:
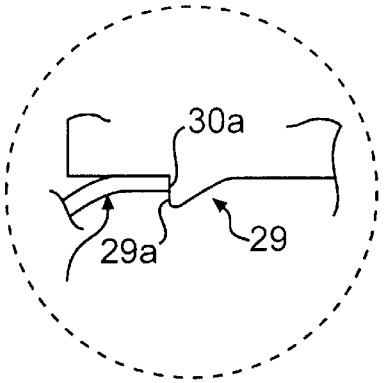
Figure 3B:
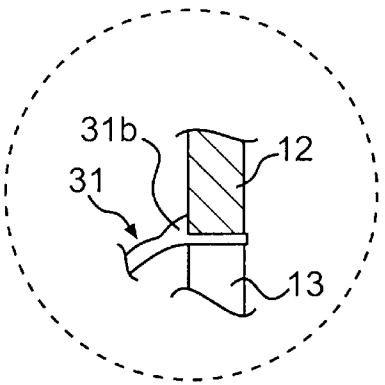

First of all, as shown in FIG. 3, the moving part 22 is inserted into the fixing part 23 of the male connector 20, and the moving part 22 is locked in a state in which a terminal face 25*a* of the moving part 22 projects a predetermined distance A from a terminal face 25*b* of the fixing part 23.

Namely, when the moving part 22 is inserted into the moving part receiving portion 24 of the fixing part 23, the locking arms 30 are brought into sliding contact with the projections 29 and are then deflected toward the moving part 22 side, and when the terminating faces 30*a* of the locking arms 30 come to the positions of the locking faces 29*a* of the moving part holding projections 29, the locking arms 30 of the moving part 22 ride over the moving part holding projections 29 and elastically is restored to the original state thereof, whereby the end faces 30*a* come to abutment with the engagement faces 29*a* of the moving part holding projections 29. This prevents the moving part 22 from being moved in a direction opposite to the inserting direction, while as shown in FIG. 2, the guides 27 of the moving part 22 come into abutment with the terminating faces 28 of the moving part guide grooves 26, thereby preventing the moving part 22 from falling out of the moving part receiving portion 24. Consequently, the moving part 22 is locked in a state in which the moving part 22 projects from the fixing part 23 the predetermined distance A.

Next, the male connector 20 is inserted into the mounting hole 13 of the vehicle body from the right hand side in FIG. 3, and the locking arms 31 are elastically locked at the vehicle body 12, whereby the male connector 20 is fixed thereto. In other words, a projection 31*b* is formed on a sliding face at an end of the respective fixing arms 31, and these projections 31*b* come into engagement with end portions of the mounting hole 13, and the male connector 20 is locked at the vehicle body 12 by virtue of the elastic restoring force of the fixing arms 31. In addition, as shown in FIG. 1, stoppers 15 are provided on upper and lower external sides of the fixing part 23 of the male connector 20 in such a manner as to project therefrom so that the male connector 20 is prevented from falling out of the mounting hole 13 of the vehicle body 12 in the forward direction when these stoppers 15 come into abutment with the upper and lower end portions of the mounting hole 13 of the vehicle body 12.

Figure 4A:
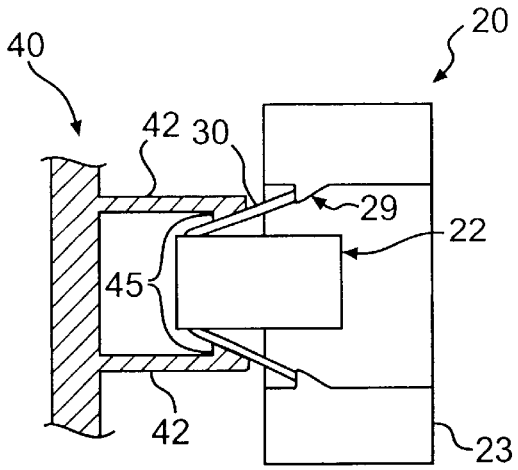
FIGS. 4 (*a*) to (*c*) are views showing steps of coupling the moving part into the female connector.
Figure 4B:
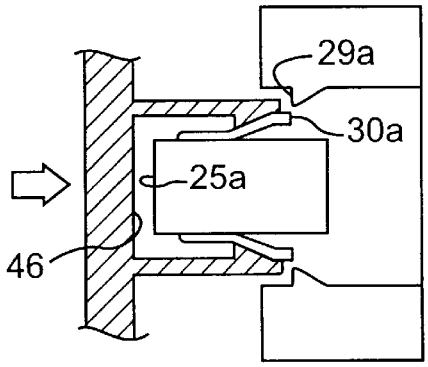
Figure 4C:
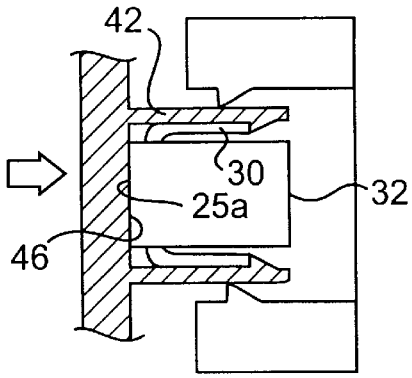

The female connector 40 is inserted on the male connector 20 with the male connector 20 being locked at the mounting hole 13 of the vehicle body 12. Each of steps of inserting the female connector 40 on the male connector 20 is shown in FIG. 4. FIG. 4(*a*) shows a step in which the moving part 22 projecting from the male connector 22 starts to be inserted into the moving part fitting-in frame 42 of the female connector 40. The fixing arms 30 of the moving part 22 are brought into sliding contact with the moving part fitting projections 45 and are then deflected thereby. Then, passing through a step shown in FIG. 4(*b*) in which an engagement between the end faces 30*a* of the fixing arms 30 and the engagement faces 29*a* of the moving part holding projections 29 is released, as shown in FIG. 4(*c*), the terminal face 25*a* of the moving part 22 is brought into abutment with a moving part fitting-in bottom face 46, when the fitting of the moving part 22 in the moving part fitting-in frame 42 is completed. In addition, in this step, although not shown, electrical connection terminals provided on the moving part fitting-in bottom face 46 in such a manner as to erect therefrom are inserted into the terminal receiving portion 21*a* of the moving part 22 in a perfect fashion. A fitting force required in these inserting steps is a force involved in the coupling of the moving part 22.

Figure 5:
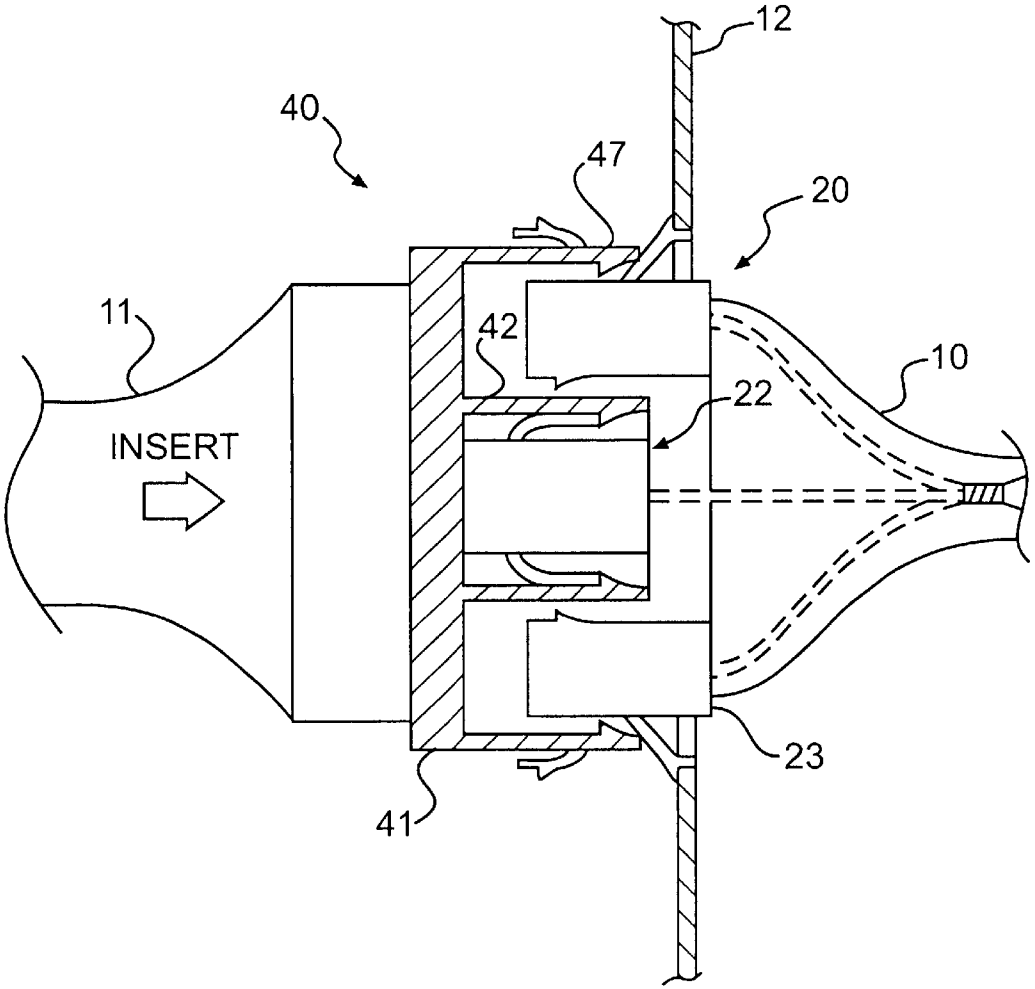
FIG. 5 is a view showing a state in which the moving part is coupled in the female connector.
Figure 6A:
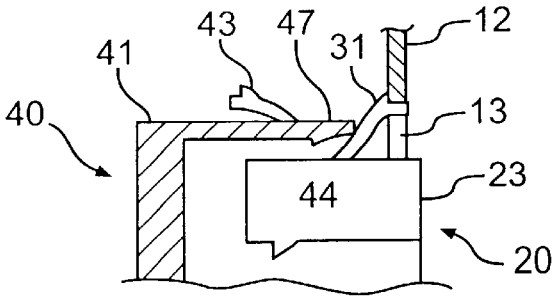
FIGS. 6 (*a*) to (*d*) are views showing steps of coupling the fixing part to the female connector.
Figure 6B:
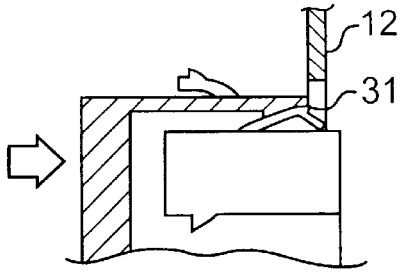
Figure 6C:
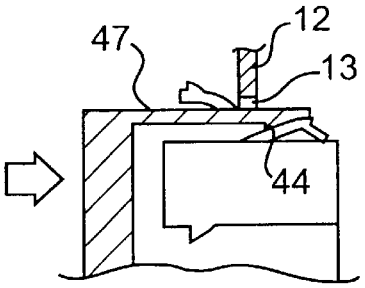
Figure 6D:
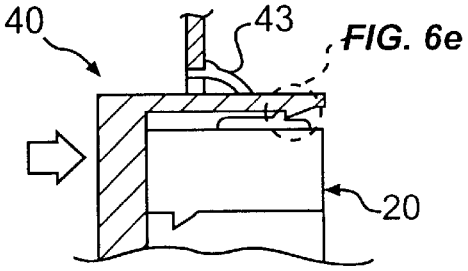
Figure 6E:
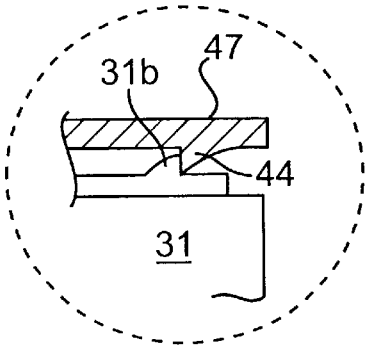

FIG. 5 shows a state in which the moving part 22 is fitted in the female connector 40. According to FIG. 5, the moving part 22 of the male connector 20 is fitted in the moving part fitting-in frame 42 of the female connector 40, and the fixing part 23 of the male connector 20 starts to be fittingly inserted into a connector wall 47 of the female connector 40.

Next, the female connector 40 is further inserted on the male connector 20. Then, as shown in FIG. 6(*a*), the end portions of the connector wall 47 of the female connector 40 are pressed against the fixing arms 31 which are fixing the male connector 23 to the mounting hole 13 of the vehicle body 12. Then, as shown in FIG. 6(*b*), the engagement between the fixing arms 31 and the vehicle body 12 is released when the fixing arms 31 are pressed down by the connector wall 47. Furthermore, as shown in FIG. 6(*c*), when released from the engagement with the vehicle body 12, the fixing arms 31 then slidingly move along the male connector holding projections 44 in response to the insertion of the female connector 40, and concurrently with this, the female connector 40 is inserted into the mounting hole 13 of the vehicle body 12 in a direction indicated by an arrow.

Then, as shown in FIG. 6(*d*), the female connector 40 fits on the male connector 20. A fitting force required in these steps is a force involved only in the coupling of the fixing part 23. In addition, the male connector holding projections 44 engage the projections 31*b* of the fixing arms 31 at a position where the engagement is completed, and the male connector 20 is prevented from coming off the female connector 40.

Furthermore, the vehicle body supporting arms 43 are locked in the mounting hole 13 of the vehicle body 12 instead of the fixing arms 31, while the forward falling-out preventing stoppers 16 come into abutment with the upper and lower end portions of the mounting hole 13 of the vehicle body 12, this preventing the female connector 40 not only from falling out in the inserting direction but also from being inserted into the mounting hole 13 excessively.

Figure 7:
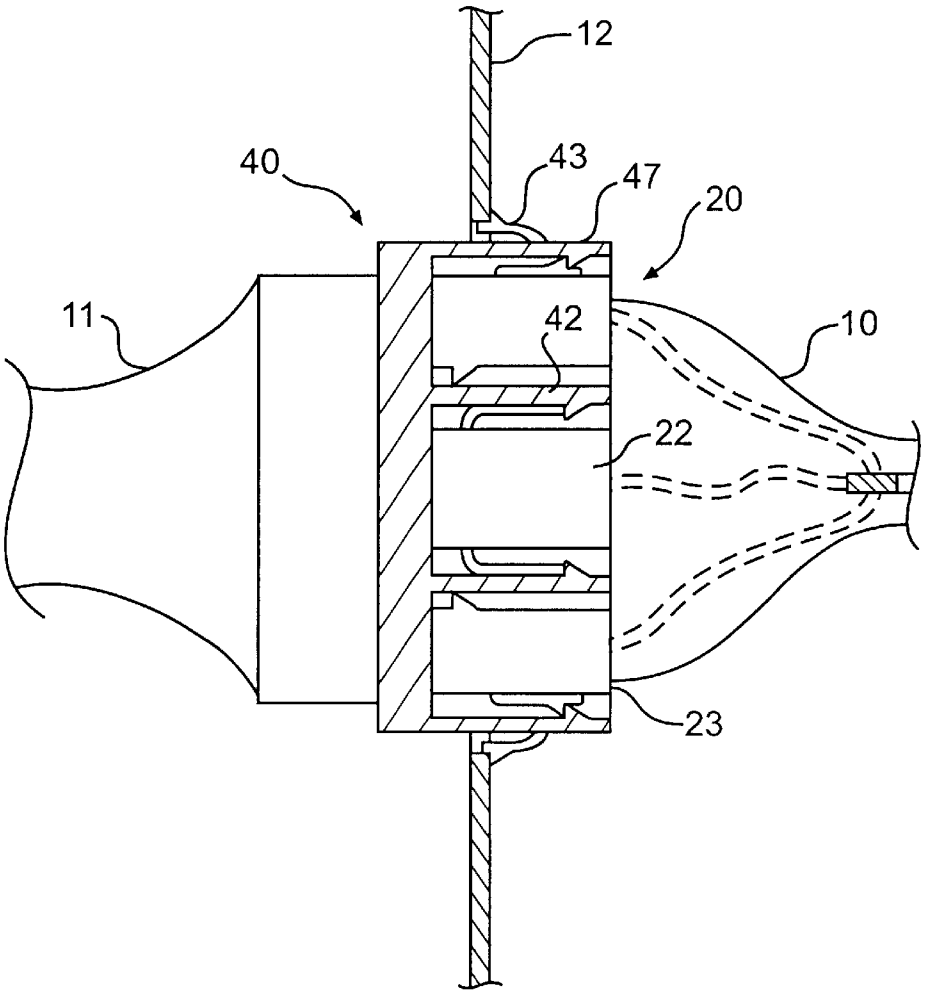
FIG. 7 is a view showing a state in which the male and female connectors are fitted in each other.

FIG. 7 shows a state in which the female connector 40 is inserted and fitted on the male connector 20. According to FIG. 7, the fixing part 23 and the moving part 22 of the male connector 20 fit in the connector wall 47 and the moving part fitting-in frame 42 of the female connector 42. In this state, the wiring harness 10 side and the wiring 11 on the accessories side are electrically connected to each other.

In this condition, with the divided-type connector according to the mode of carrying out the present invention as described above, even if the moving part 22 is half fitted in the female connector 40, this half-fitted condition can be detected in insertion.

Figure 8:
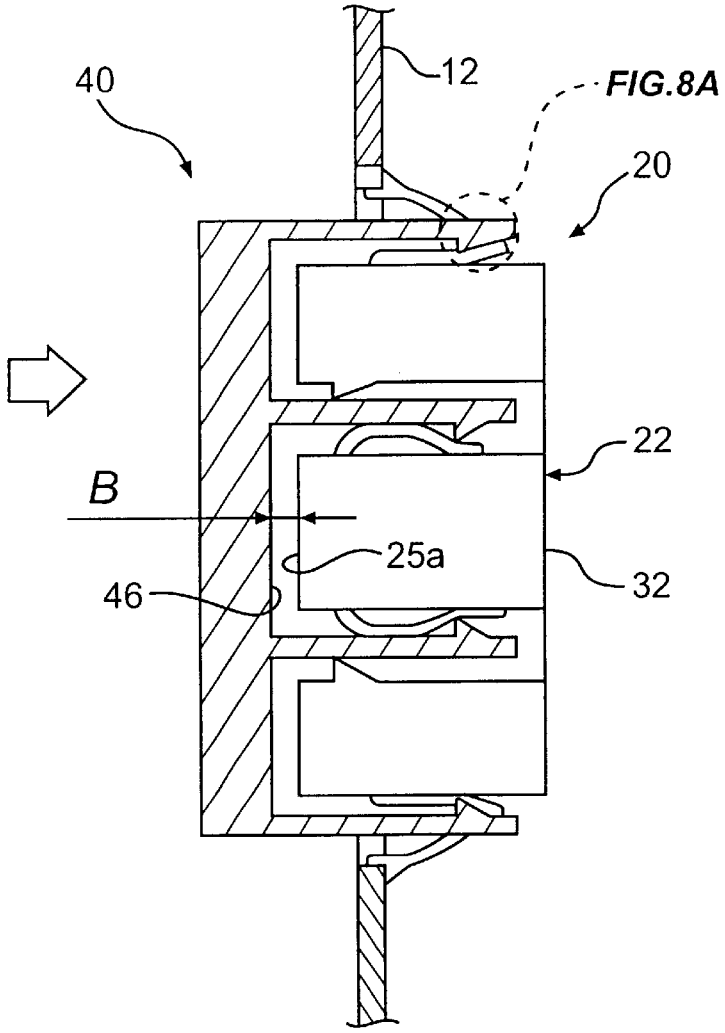
FIG. 8 is a view describing a coupled state between the male and female connectors, which are half-fitted in each other.
Figure 8A:
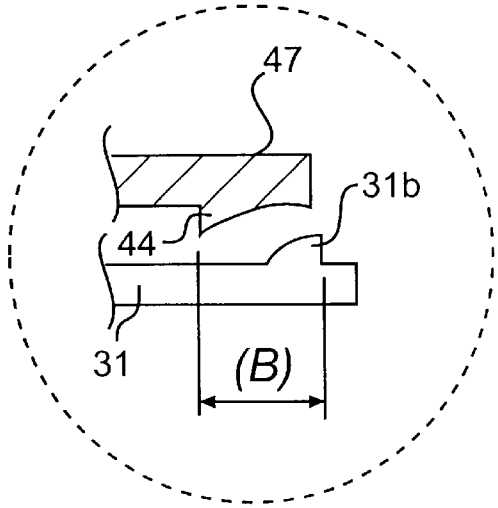

Specifically speaking, when the fixing part 23 of the male connector 20 is fitted in the connector main body 41, if the former is half fitted in the latter, as shown in FIG. 8, the terminal face 25*a* of the moving part 22 is separated from the moving part fitting-in bottom face 46 as if it were floating thereover. A side of the moving part 22 opposite to the terminal face 25*a* is pressed against the fixing part due to a separation distance B. As a result of this, the male connector holding projections 44 of the connector wall 47 of the female connector 40 are left separated from the projections 31*b* of the fixing arms 31 of the male connector 20 by a distance corresponding to the separation distance B above, thus an engagement between the projections being prevented. Consequently, even if a pressure is applied to with a view to fitting the connectors in each other, no feel, sound or reaction force can be felt irrespective of the fact that the connectors are pressed against each other to a predetermined position. Thus, the inserting operation ends up in a state clearly different from one in which a proper fit is attained, and therefore the operator who tries to couple the connectors can easily detect a half-fitted condition.

Thus, as has been described heretofore, according to the divided-type connector in accordance with the mode of carrying out the present invention, the male connector 20 comprises the fixing part 23 and the moving part 22, and the female connector 40 starts to be inserted on the male connector 20 with the moving part 22 being held such that the terminal face 25*a* of the moving part 22 projects forward in the inserting direction the predetermined distance A from the terminal face 25*b* of the fixing part 23. In insertion, the moving part 22 fits in the female connector 40 earlier than the fixing part does, and as the fixing part 23 fits in the female connector 40, the moving part 22 is pressed into the female connector 40 to the extent that the moving part 22 does not project from the terminal face 25*b* of the fixing part 23.

Consequently, first the moving part 22 of the male connector 20 fits in the moving part fitting-in frame 42 of the female connector 40, and following this, the fixing part 23 of the male connector 22 is fitted in the connector wall 47 of the female connector 40.

Figure 9:
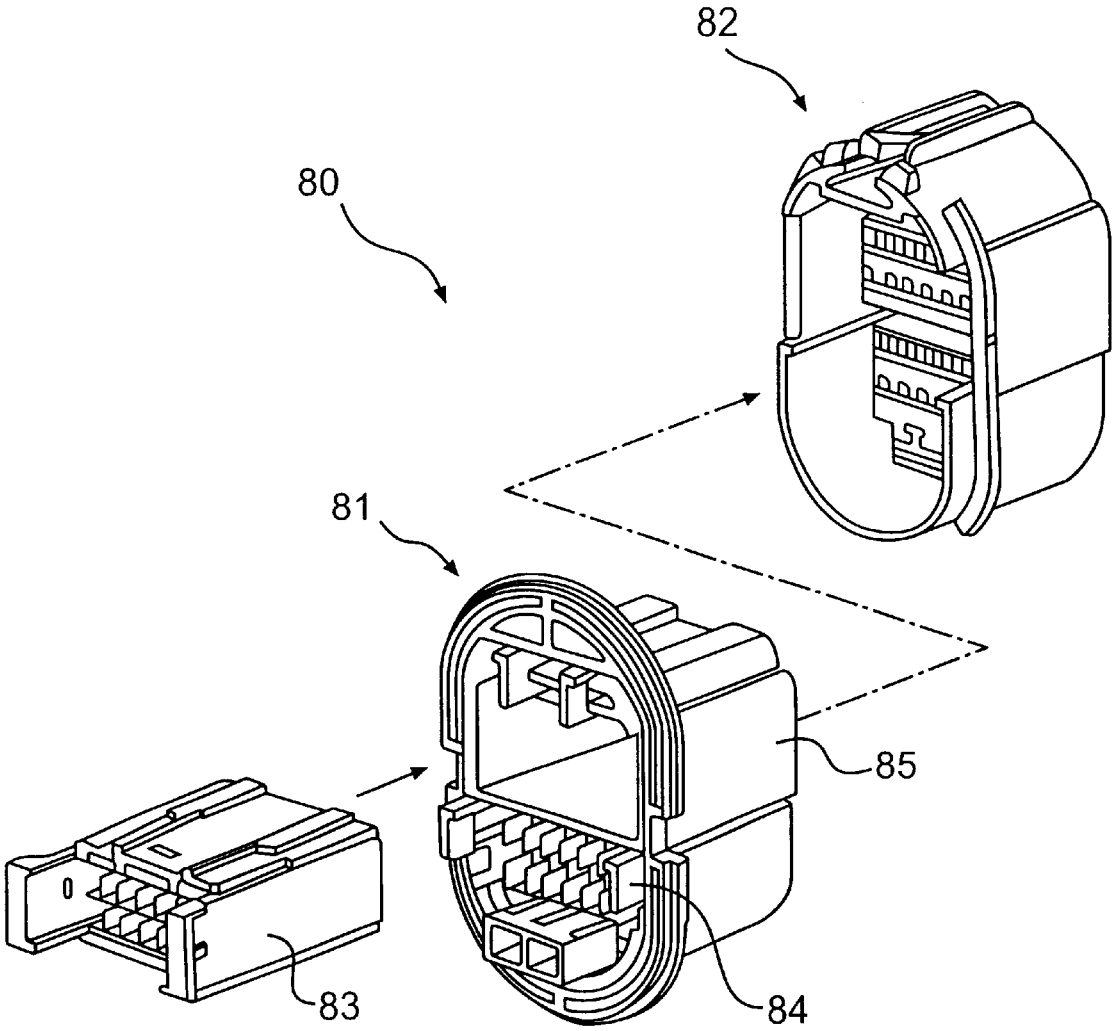
FIG. 9 PRIOR ART
FIG. 9 is a view showing the construction of a conventional divided-type connector.

This serves to divide the fitting force needed for the male connector 20 to be fitted in the female connector 40 so as to reduce it, and moreover, a plurality of fitting operations are no more required as in the case with the conventional divided-type connector 80 (FIG. 9). In other words, since the divided-type connector units (the moving part 22 and the fixing part 23) can be sequentially coupled through a single coupling operation of fitting the male connector 20 in the female connector 40, a good coupling operability can be obtained.

Furthermore, the moving part 22 and the fixing part 23 of the male connector 20 can be fitted in the female connector 40 in a secured fashion, while detecting a half-connected condition thereof and the fitted condition can securely be maintained.

In the above-described mode of carrying out the present invention, a wiring harness side connector is described as the male connector and an accessories side connector as the female connector, but the present invention is not limited to such a construction, and the male and female connectors may be constructed in a reverse fashion.

According to the divided-type connector of the present invention, one of the connectors being divided-type into a plurality of connector units, so that each of the connector units so divided-type is coupled to the other connector, wherein the one of the connectors comprises a fixing part having an opening hole formed in a coupling face thereof and a moving part adapted to be received in the opening hole for locking therein with a part thereof being left projecting from the coupling face in a coupling direction, and wherein after the moving part is coupled to the other connector, the fixing part is coupled to the other connector while the moving part is being moved in the fixing part. Owing to this construction, since the force required for the male connector to be coupled to the female connector is divided, the force can be reduced, and since the moving part and the stationary force can be coupled in a single inserting operation, a good coupling operability can be obtained.

In addition, since the one of the connectors is fixed to the other connector for the first time when not only the moving part but also the fixing part is coupled to the other connector, a half-fitted condition of the moving part or fixing part can easily be detected.

What is claimed is:

1. A divided-type connector comprising:

a male connector and a female connector, one of said connectors being divided into a plurality of connector units, so that each of said connector units is coupled to the other connector; and a fixing part having an opening hole formed in a coupling face thereof and a moving part adapted to be received in said opening hole for locking therein with a part thereof being projected from said coupling face in a coupling direction, said fixing part and said moving part provided on one of said connectors and wherein after said moving part is coupled to said other connector, said fixing part is coupled to said other connector while said moving part is being moved in said fixing part.

2. A divided-type connector as set forth in claim 1, further comprising:

a locking member locking said moving part on said fixing part, said locking member disposed on sides of said moving part, and wherein the locking of said locking member with said fixing part is released when said moving part is fitted in said other connector, so that said locking member is fixed to said other connector.

3. A divided-type connector as set forth in claim 2, further comprising:

a first fixing member for securing a coupled state with said the other connector, said first fixing member disposed on external sides of one connector, wherein once said moving part and said fixing part are coupled to said the other connector, said first fixing member can come to be fixed.

4. A divided-type connector as set forth in claim 3, further comprising:

a second fixing member provided with said other connector to be fixed at a wall face; and a connector mounting hole through which said one connector and said the other connector are coupled at said wall face, wherein said one connector is fixed at said wall face by said first fixing member before said one connector is coupled to said the other connector, a fixation of said one connector effected by said first fixing member is released along a coupling operation between said one connector and said other connector, said other connector being fixed to said wall face by said second fixing member when the coupling of said other connector with said one of said connectors is completed.

* * * * *